US007351455B2

(12) United States Patent
Binder

(10) Patent No.: US 7,351,455 B2
(45) Date of Patent: Apr. 1, 2008

(54) PARAFFIN RING FOR PARAFFINING YARN

(75) Inventor: Michael Binder, Albstadt (DE)

(73) Assignee: Siegfried Binder, Albstadt (DE)

( * ) Notice: Subject to any disclaimer, the term of this patent is extended or adjusted under 35 U.S.C. 154(b) by 527 days.

(21) Appl. No.: 10/636,964

(22) Filed: Aug. 8, 2003

(65) Prior Publication Data

US 2004/0069218 A1 Apr. 15, 2004

(30) Foreign Application Priority Data

Aug. 15, 2002 (WO) ..... PCT/EP02/09126

(51) Int. Cl.
*B32B 1/08* (2006.01)

(52) U.S. Cl. ..... 428/34.1; 428/35.7; 428/36.9; 428/36.91; 118/78

(58) Field of Classification Search ..... 428/35.7, 428/36.91, 36.9, 78; 118/78
See application file for complete search history.

(56) References Cited

U.S. PATENT DOCUMENTS

| | | | | |
|---|---|---|---|---|
| 3,373,718 | A | 3/1968 | Brouwer et al. | 118/78 |
| 3,393,660 | A | 7/1968 | Walden | 118/234 |
| 3,479,988 | A * | 11/1969 | Trost et al. | 118/78 |
| 4,244,176 | A | 1/1981 | Shimizu et al. | 57/295 |
| 5,879,455 | A * | 3/1999 | Stahlecker | 118/78 |
| 5,902,755 | A * | 5/1999 | Driggett et al. | 442/172 |

* cited by examiner

*Primary Examiner*—Marc A. Patterson
(74) *Attorney, Agent, or Firm*—Shlesinger, Arkwright & Garvey LLP

(57) ABSTRACT

Paraffin ring for paraffining yarn, which has a substantially cylindrical shape, with a paraffin jacket (12) and an insertion bore (14) of substantially circular cross-section, extending concentrically to a central longitudinal axis of the paraffin ring (10), for placing the paraffin ring (10) on a holder provided for this purpose, the paraffin ring (10) having in the paraffin jacket (12), at an end (16) close to the holder, at least one taphole (20, 22, 24) extending substantially parallel to the insertion bore (14) and not passing right through.

12 Claims, 2 Drawing Sheets

PARAFFIN RING FOR PARAFFINING YARN

The present invention relates to a paraffin ring for paraffining yarn.

Paraffin rings of this kind are known and are used in the manufacture of yarn, particularly in rotor spinning machines and winders, as is known from DE 100 62 096 A1. The known rings have a substantially cylindrical shape, with a paraffin jacket and an insertion bore running concentrically to a central longitudinal axis of the paraffin ring. The insertion bore has a substantially circular cross-section by means of which the paraffin ring is fitted onto a holder provided for this purpose. At its end next to the holder the paraffin ring has a so-called guide phase by means of which it is aligned with and connected for rotation with the holder. The holder may be, for example, a spindle-like pin.

In operation, a yarn is guided under frictional contact over the end of the paraffin ring remote from the holder, as a result of which paraffin remains on the yarn and the yarn is "paraffined". The paraffin ring is gradually worn away as paraffin is released onto the yarn. Once the paraffin ring has worn away to a minimum it has to be replaced. However, as the paraffin rings in rotor spinning machines or winders are secured relatively high up (above eye level for many operators), it is not easy for the operating staff to tell when a paraffin ring needs to be changed. Therefore, in many cases, the paraffin ring is changed too early, resulting in a waste of material, or it is changed too late, which affects the quality of the yarn.

Starting from this, the invention provides a paraffin ring having the features of claim 1.

The paraffin ring according to the invention has, in the paraffin jacket at an end adjacent to the holder, at least one taphole extending substantially parallel to the insertion bore but not going right through. As the paraffin ring wears away, its length decreases from the end remote from the holder towards the holder. At a certain moment, i.e. the precise moment when the remaining length of the paraffin ring precisely corresponds to the depth of the at least one taphole, the taphole in the paraffin jacket becomes visible. On inspecting the paraffin rings, the operating staff are able to see the taphole which was not previously visible and from this are able to conclude that the paraffin ring will shortly need changing. The term "paraffin jacket" is used in the geometric sense to mean the jacket or peripheral or lateral portion of the cylinder around the insertion bore.

According to a particularly advantageous embodiment of the invention, in order to improve visual recognition, a plurality of tapholes are provided in the paraffin jacket, preferably two, three or four tapholes. Of course, more than four tapholes may also be provided.

In a particularly preferred embodiment of the invention the paraffin ring comprises a plurality of tapholes of different depths. This means that as the length of the paraffin ring decreases the tapholes become visible one after the other so that the operating staff are better able to estimate the time remaining before the paraffin ring has to be changed. An embodiment with three tapholes with depths of 6 mm, 8 mm and 10 mm has proved particularly advantageous.

Further advantages and embodiments of the invention will become apparent from the description and the accompanying drawings.

It will be understood that the features described above and those to be explained hereinafter may be used not only in the combination specified but also in other combinations or on their own without departing from the scope of the present invention.

The invention is schematically shown in the drawings by means of an embodiment by way of example and is described in more detail hereinafter with reference to the drawings.

Figure 1:
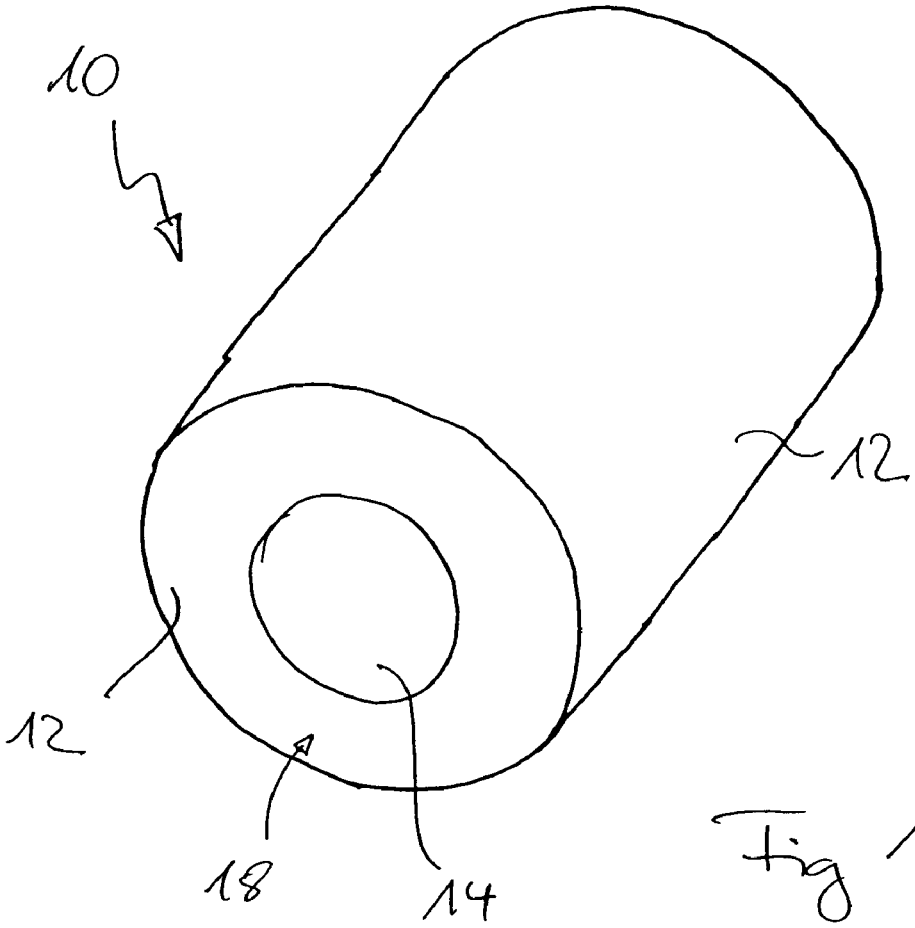
FIG. 1 shows a paraffin ring according to the invention in perspective view looking at an end of the paraffin ring remote from the holder.

FIG. 1 shows, in a perspective view a paraffin ring 10 for applying paraffin to yarn according to the invention. The paraffin ring 10 comprises a paraffin jacket 12 and an insertion bore 14 for placing the paraffin ring 10 on a holder provided for this purpose (not shown) on an apparatus for manufacturing or processing yarn, such as a rotor spinning machine or a winder. The insertion bore 14 extends concentrically to a central longitudinal axis of the paraffin ring 10.

In the illustration shown in FIG. 1, the end closest to the viewer is an end 18 of the paraffin ring 10 remote from the holder. In this illustration the paraffin ring according to the invention does not differ from the paraffin rings known hitherto as used in apparatus for the production or processing of yarn.

Figure 2:
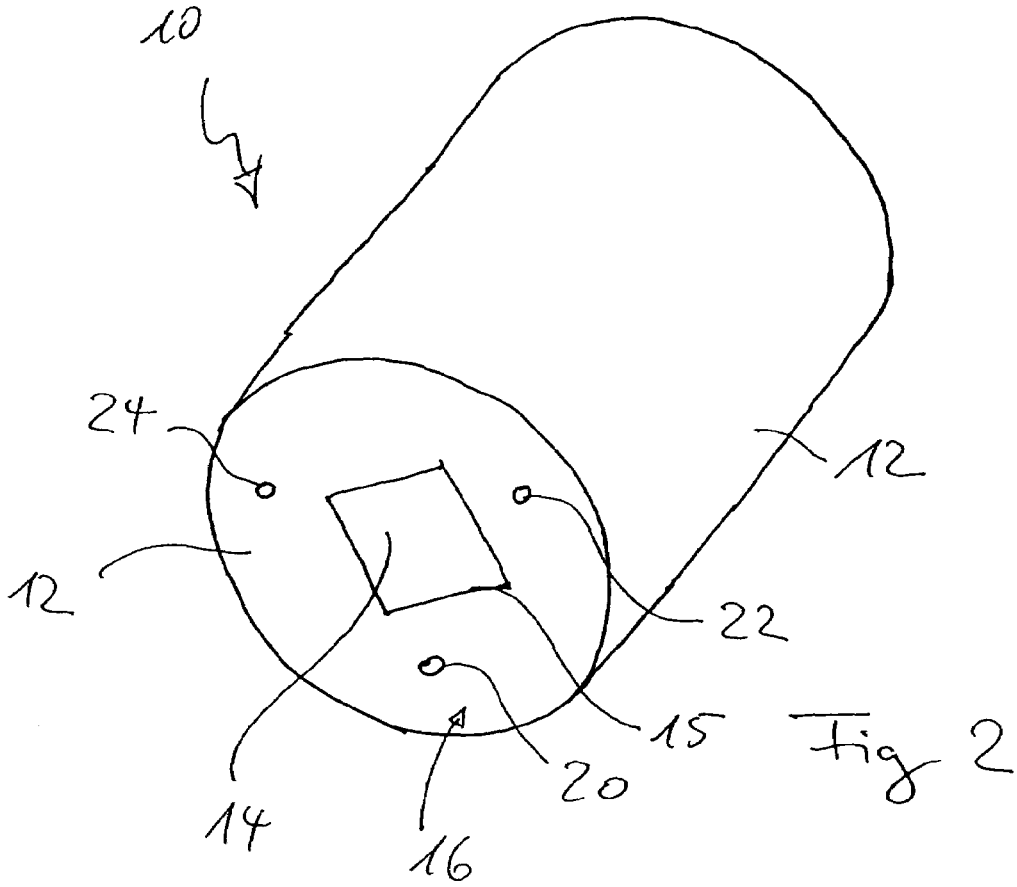
FIG. 2 shows the paraffin ring of FIG. 1 in perspective view looking at an end of the paraffin ring closest to the holder.

FIG. 2 shows the paraffin ring 10 of FIG. 1 according to the invention in perspective view from the opposite direction, i.e. from the viewpoint of an end 16 of the paraffin ring 10 closest to the holder. Also visible is the insertion bore 14 running through it which does not have a circular cross-section at the end 16 closest to the holder but rather has an angular cross-section (a square cross-section in the embodiment shown) which acts as a guide phase 15. Other non-circular cross-sectional geometric shapes, such as an oval cross-section, for example, may also be used as the guide phase.

Additionally, the paraffin ring 10 according to the invention has three tapholes 20, 22, 24 provided in the paraffin jacket 12 at the end 16 closest to the holder and extending substantially parallel to the insertion bore 14.

Figure 3:
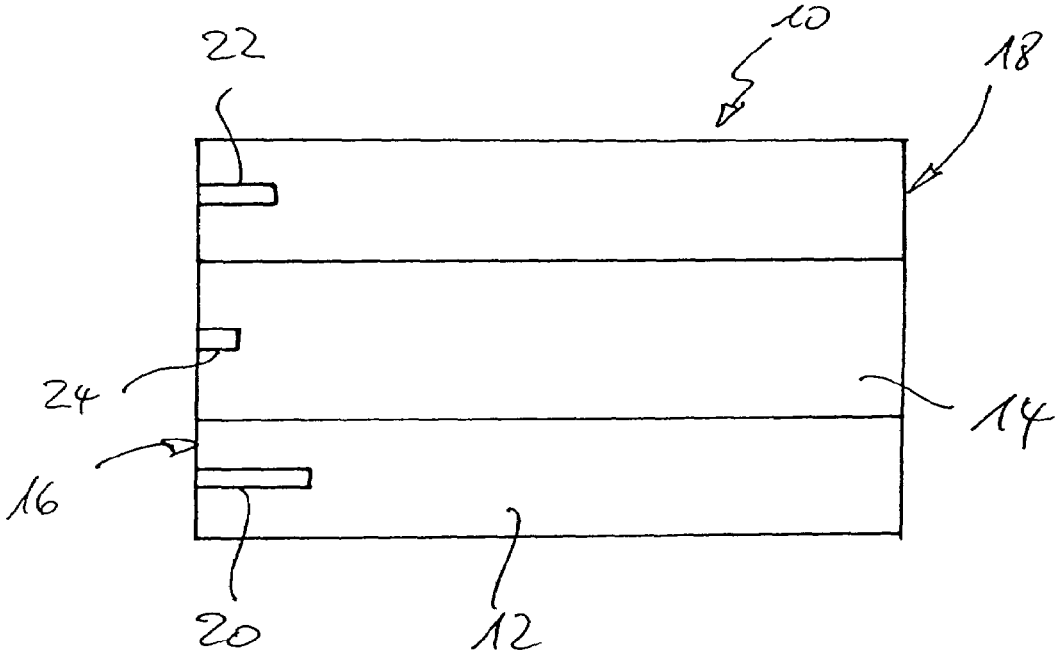
FIG. 3 shows a lateral view looking through the paraffin ring of FIGS. 1 and 2.

The three tapholes 20, 22, 24 are comparatively shallow. The paraffin ring 10 has a length of several centimetres, for example 4 to 5 cm (although the length and diameter of the paraffin ring may vary depending on the particular application), while the tapholes are just a few millimetres deep. This is illustrated in the representation in FIG. 3, which is schematic and not to scale. FIG. 3 shows the paraffin ring 10 of FIGS. 1 and 2 according to the invention looking through it from the side.

At its end 16 next to the holder (on the left in the representation of FIG. 3) the paraffin ring 10 comprises the above-mentioned tapholes 20, 22, 24 in the paraffin jacket 12. The three tapholes 20, 22, 24 are preferably of different depth. In the embodiment illustrated, a first (bottom) taphole 20 is the deepest, a second (top) taphole is of medium depth and finally a third (middle) taphole 24 is the shallowest. The depths of the tapholes may also vary depending on the particular application, while depths of 6 mm, 8 mm and 10 mm for the three tapholes have proved particularly advantageous. At least, the minimum depth should be selected so that it is not less than the minimum length of a worn out or used up paraffin ring.

In operation, the paraffin ring 10 according to the invention is inserted in the holder provided for this purpose in a manner already known in the art. Yarn runs under frictional contact over the end 18 of the paraffin ring 10 remote from the holder, during which time paraffin remains on the yarn (and thus produces so-called paraffining of the yarn), as a result of which the paraffin ring 10 wears away so that its length decreases with the period of use. In the illustration of FIG. 3 this means that the paraffin ring 10 becomes shorter from the end 18 remote from the holder (on the right) towards the left. Once the wearing away of the paraffin ring 10 has progressed to such a point that the bottom of the first (and deepest) taphole 20 is reached, this taphole becomes visible in the surface of the paraffin jacket 12 at the end 18 of the paraffin ring 10 remote from the holder. An operator is alerted by the visibility of the first, deepest taphole 20 to the fact that the paraffin ring 10 has worn away to a certain degree but that it is not yet necessary to change it. As the paraffin ring 10 continues to wear away towards the end 16 closest to the holder, the two other tapholes 22 and 24 successively become visible, and as the middle taphole 22 becomes visible the operating staff are alerted to the fact that the paraffin ring 10 has to be changed shortly, so that when the last, shortest taphole 24 becomes visible the paraffin ring 10 can be changed without delay.

Figure 4:
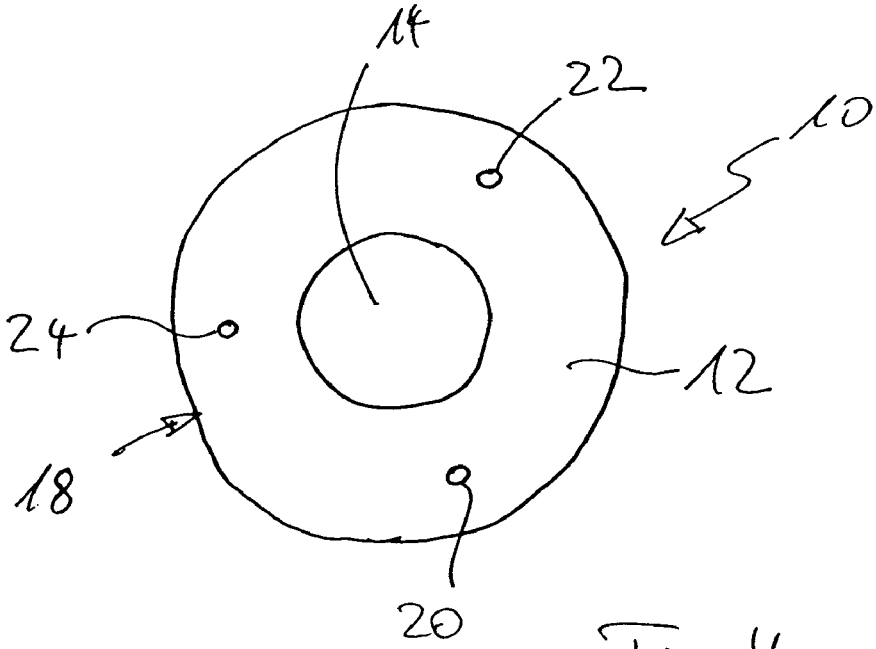
FIG. 4 shows a plan view of the end of the paraffin ring of FIG. 1 remote from the holder.

FIG. 4, which is a plan view of the end 18 of the paraffin ring 10 remote from the holder, illustrates its appearance of the paraffin ring when all three tapholes 20, 22, 24 are visible, i.e. the paraffin ring 10 (or what is left of it) has to be replaced.

The invention provides, in a simple but highly reliable manner, a paraffin ring for paraffining yarn which prevents the paraffin ring which has worn away from being changed too soon or too late. This is achieved, as described, by means of one or more tapholes according to the invention.

The invention claimed is:

1. A paraffin ring for paraffining yarn, said paraffin ring comprising:

a) a paraffin cylindrical member, said cylindrical member having a first end and a second end, said second end adapted to engage a yarn to be paraffined;

b) an insertion bore for receiving said cylindrical member on a holder when paraffining yarn, said insertion bore extends concentrically through said cylindrical member and along a central longitudinal axis thereof; and c) at least one taphole, said at least one taphole extends into said cylindrical member at said first end and substantially parallel to said insertion bore but not to said second end so that when said cylindrical body member second end is caused to engage a yarn to paraffin the same, said second end is worn away and said at least one taphole is caused to extend to the worn second end and provide a visual signal, said paraffin ring for paraffining yarn further including at least one additional taphole and wherein each of said at least one taphole and said at least one additional taphole has a different depth.

2. A paraffin ring for paraffining yarn as in claim 1 and further including a third taphole.

3. A paraffin ring for paraffining yarn as in claim 2 and further including a fourth taphole.

4. A paraffin ring for paraffining yarn as in claim 2 and wherein said at least one taphole has a depth of 6 mm, said second taphole has a depth of 8 mm and said third taphole has a depth of 10 mm.

5. A paraffin ring for paraffining yarn as in claim 1 and wherein said paraffin cylindrical member is a jacket.

6. A paraffin ring for paraffining yarn as in claim 1 and wherein at least a portion of said insertion bore has a cross-sectional shape selected from the group consisting of circular, square and oval cross-sectional shapes.

7. A paraffin ring for paraffining yarn, said paraffin ring comprising:

a) a paraffin cylindrical member, said cylindrical member having a first end and a second end, said second end adapted to engage a yarn to be paraffined;

b) an insertion bore for receiving said cylindrical member on a holder when paraffining yarn, said insertion bore extends concentrically through said cylindrical member and along a central longitudinal axis thereof; and c) at least one wear indicator, said at least one wear indicator including at least one taphole and extends into said cylindrical member at said first end and substantially parallel to said insertion bore but not to said second end so that when said cylindrical body member second end is caused to engage a yarn to paraffin the same, said second end is worn away and said at least one wear indicator is exposed at the worn second end and further including at least one additional wear indicator wherein each of said at least one wear indicator and said at least one additional wear indicator has a different depth.

8. A paraffin ring for paraffining yarn as in claim 7 and further including a third wear indicator.

9. A paraffin ring for paraffining yarn as in claim 8 and further including a fourth wear indicator.

10. A paraffin ring for paraffining yarn as in claim 8 and wherein said at least one wear indicator has a depth of 6 mm, said second wear indicator has a depth of 8 mm and said third wear indicator has a depth of 10 mm.

11. A paraffin ring for paraffining yarn as in claim 7 and wherein said paraffin cylindrical member is a jacket.

12. A paraffin ring for paraffining yarn as in claim 7 and wherein said insertion bore has a cross-sectional shape selected from the group consisting of circular, oval and square cross-sectional shapes.

* * * * *